US006215450B1

(12) United States Patent
Oka

(10) Patent No.: US 6,215,450 B1
(45) Date of Patent: Apr. 10, 2001

(54) GLASS WINDOW ANTENNA SYSTEM FOR MOTOR VEHICLES

(75) Inventor: Hidetoshi Oka, Osaka (JP)

(73) Assignee: Nippon Sheet Glass Co., Ltd., Okaka (JP)

( * ) Notice: Subject to any disclaimer, the term of this patent is extended or adjusted under 35 U.S.C. 154(b) by 0 days.

(21) Appl. No.: 09/323,791

(22) Filed: Jun. 2, 1999

(30) Foreign Application Priority Data

Jun. 4, 1998 (JP) ..... 10-155592

(51) Int. Cl.[7] ..... H01Q 1/32
(52) U.S. Cl. ..... 343/713; 343/704
(58) Field of Search ..... 343/713, 704, 343/850, 853

(56) References Cited

U.S. PATENT DOCUMENTS

| | | | | |
|---|---|---|---|---|
| 3,771,159 | | 11/1973 | Kawaguchi et al. | 343/713 |
| 5,313,217 | * | 5/1994 | Kakizawa | 343/713 |
| 5,719,585 | * | 2/1998 | Tabata et al. | 343/713 |
| 5,793,333 | * | 8/1998 | Taniguchi et al. | 343/713 |
| 5,905,468 | * | 5/1999 | Ikawa et al. | 343/713 |
| 5,907,308 | * | 5/1999 | Oka et al. | 343/713 |
| 5,933,119 | * | 8/1999 | Fujii et al. | 343/713 |

FOREIGN PATENT DOCUMENTS

| | | | |
|---|---|---|---|
| 0 471 449 | 2/1992 | (EP) | H01Q/1/32 |
| 0 559 196 | 9/1993 | (EP) | H01Q/1/32 |
| 58-070643 | 7/1983 | (JP) | H01Q/1/32 |
| 9-181513 | 11/1997 | (JP) | H01Q/1/32 |

OTHER PUBLICATIONS

European Search Report, Sep. 20, 1999.

* cited by examiner

*Primary Examiner*—Don Wong
*Assistant Examiner*—Hoang Nguyen
(74) *Attorney, Agent, or Firm*—Ratner & Prestia

(57) ABSTRACT

A glass window antenna system for motor vehicles, in which a receiving sensitivity in an AM band is increased, is provided. One AM/FM antenna pattern is provided on a rear window, which has a pattern mainly receiving a FM band while maintaining an AM receiving characteristic, and an AM antenna pattern is provided which has an antenna pattern for obtaining AM receiving characteristic. An AM voltage received by the AM/FM antenna pattern and an AM voltage received by the AM antenna patterns are synthesized by superimposing the AM received voltage of the AM antenna patterns to the AM received voltage of the AM/FM antenna pattern through a low-pass filter.

6 Claims, 6 Drawing Sheets

GLASS WINDOW ANTENNA SYSTEM FOR MOTOR VEHICLES

BACKGROUND OF THE INVENTION

1. Field of the Invention

The present invention relates to a glass window antenna system for motor vehicles, particularly to increase the sensitivity for an AM band in the system which may receive both AM and FM bands.

2. Description of the Prior Art

As a conventional glass window antenna system for motor vehicles which may receive both AM and FM bands, there is a glass window antenna system in which antenna patterns are provided in proximity to a defogging device (hereinafter referred to as "defogger") so as to be capacitively coupled thereto. The defogger is consisted of heater wires and bus-bars provided on a rear window, the bus-bars applying a current to the heater wires. A choke coil is provided between the bus-bars and a DC power supply for the defogger.

This type of conventional glass window antenna system has various problems such as the decrease of S/N ratio due to an engine noise for the defogger, the decrease of a sensitivity for a FM band due to an interference between the antenna patterns and the defogger, and the difficulty for making the antenna system compact due to the big and heavy choke coil.

In order to dissolve these problems, there is provided a glass window antenna system for motor vehicles which may receive both AM and FM bands in Japanese laid-open publication No. 9-181513. There is shown in FIG. 1 the antenna system disclosed in this publication. The antenna system comprises a glass plate of a rear window 1, a circuit mounting component 2, an antenna terminal/power supply terminal box 3, a junction box for a second AM antenna 4, a bus-bar 5, a FM antenna 6, a first AM antenna 7, a second AM antenna 8, a receiver 9, a heater wire 10, a flexible circuit board 11, and a DC power supply 12.

FIG. 2 shows a circuitry of the circuit mounting component 2. The circuitry comprises an AM resonance inductor 13, a damping resistor 14, a high frequency inductor 15 to compensate the decrease of an impedance in an AM band wherein the AM resonance inductor 13 becomes capacitive, a damping resistor 16, an AM resonance inductor 17, a coupling capacitor 18, a connection line 19 on the flexible circuit board 11.

According to this glass window antenna system for motor vehicles, the first and second AM antennas 7, 8 provided on the glass plate 1 are connected together by the line 19 on the flexible circuit board 11. As a result, a series resonance is caused by the stray capacitance for the AM antennas 7, 8 and the inductance of the AM resonance inductor 13, and a parallel resonance is caused by the stray capacitance for AM antennas 7, 8 and the inductance of the AM resonance inductor 17. By these two kinds of resonance, i.e. the series resonance and parallel resonances, a flat sensitivity characteristic is achieved for one received frequency band. Therefore, both the AM antennas 7, 8 and the FM antenna 6 may be used for receiving an AM broadcast while increasing the sensitivity thereto.

The conventional glass window antenna system disclosed in the Japanese laid-open publication No. 9-181513 has utilized both series and parallel resonances for receiving an AM band, so that it is difficult to set appropriately the inductance values of the resonance inductors 15, 17 in order to establish both series and parallel resonance conditions, respectively.

SUMMARY OF THE INVENTION

The object of the present invention is to increase the sensitivity for an AM band in a glass window antenna system for motor vehicles by means of an extremely simple structure in a limited space other than the defogger on a rear window.

Another object of the present invention is to increase the sensitivity for an AM band in a very simple structure by using not only a rear window but also a side window(s).

According to the present invention, a glass window antenna system for motor vehicles comprises one AM/FM antenna pattern provided on a rear window which mainly receives a FM band while maintaining an AM receiving characteristic, and one or more AM antenna patterns provided on the rear window. The total occupied area of both the AM/FM antenna pattern and the AM antenna patterns has at least 0.2 $m^2$. An AM voltage received by the AM/FM antenna pattern and an AM voltage received by the AM antenna patterns are synthesized by superimposing the AM received voltage of the AM antenna patterns to the AM received voltage of the AM/FM antenna pattern through a low-pass filter.

The receiving sensitivity may be increased by means of a very simple structure, because at least one AM/FM antenna pattern and one or more AM antenna patterns are provided to synthesize the AM voltages received by these antenna patterns. The sensitivity may be further enhanced by increasing the magnitude of synthesized voltages using a resonance circuit.

DETAILED DESCRIPTION OF THE PREFERRED EMBODIMENTS OF THE INVENTION

Figure 1:
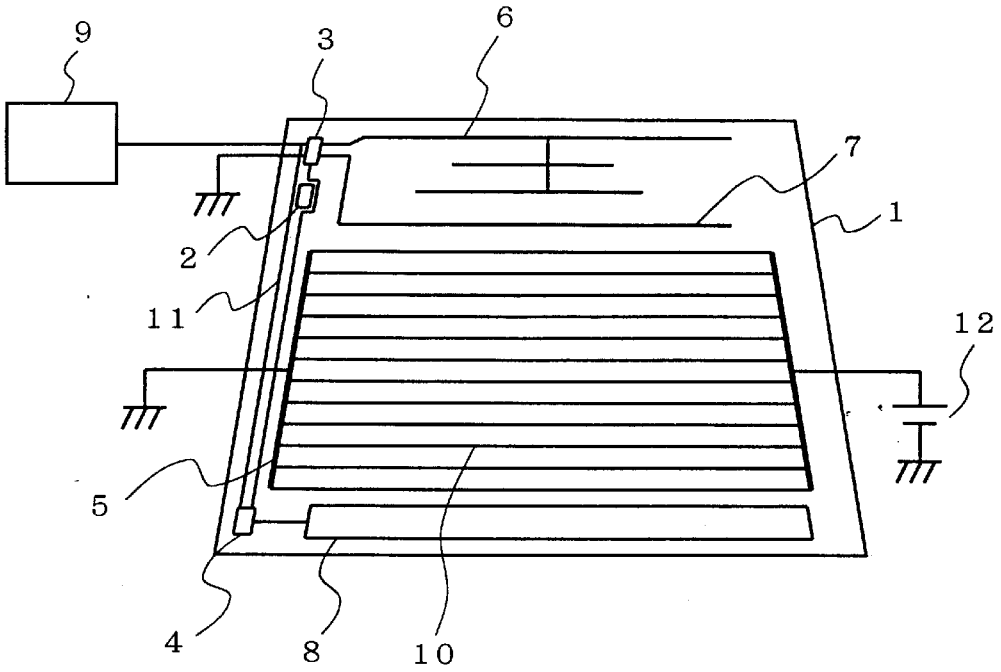
PRIOR ART FIG. 1
FIG. 1 shows a conventional antenna system.
Figure 2:
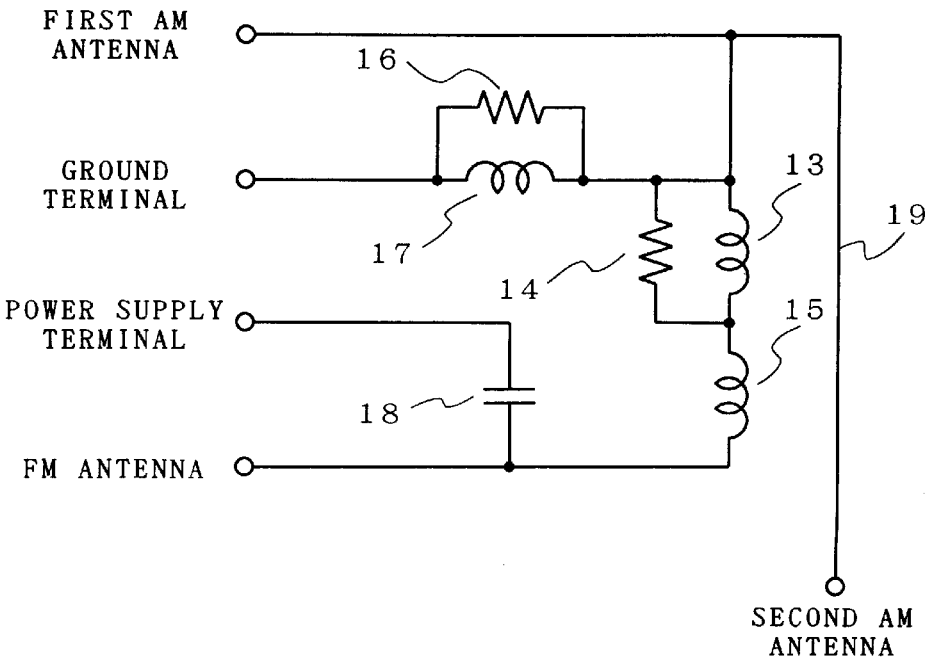
PRIOR ART FIG. 2
FIG. 2 shows a circuitry of a circuit mounting component.
Figure 3:
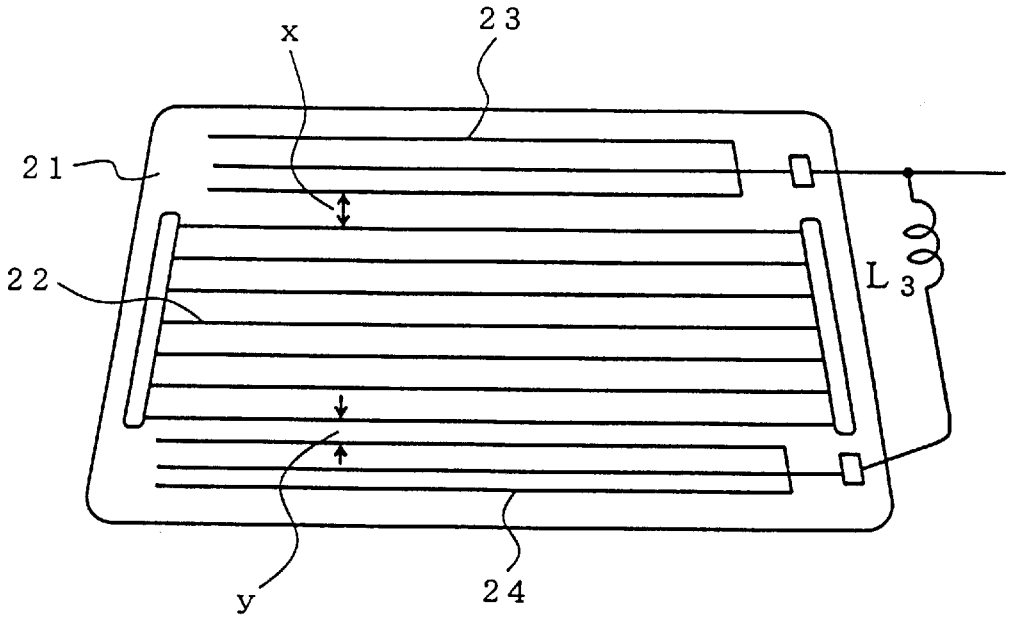
FIG. 3 shows a first embodiment of the present invention.

FIG. 3 shows a glass window antenna system of the first embodiment according to the present invention. This antenna system comprises one AM/FM antenna pattern 23 on an upper space to an area occupied by a plurality of defogging heater wires 22 provided at the center area of a glass plate 21 of a rear window, and an AM antenna pattern 24 on a lower space to the area occupied by the defogging heater wires 22, as viewed in the figure. It should be noted that the word "AM/FM antenna pattern" means the antenna pattern which is capable of receiving both AM and FM bands. The AM/FM antenna pattern 23 mainly receives a FM band while maintaining an AM receiving characteristic. In this case, the antenna pattern has a fork-shape. The distance x between the bottommost element of the AM/FM antenna pattern 23 and the topmost element of the heater wires 22, and the distance between the topmost element of the AM antenna pattern 24 and the bottommost element of the heater wires 22 are both in the range of 10–30 mm.

Figure 4:
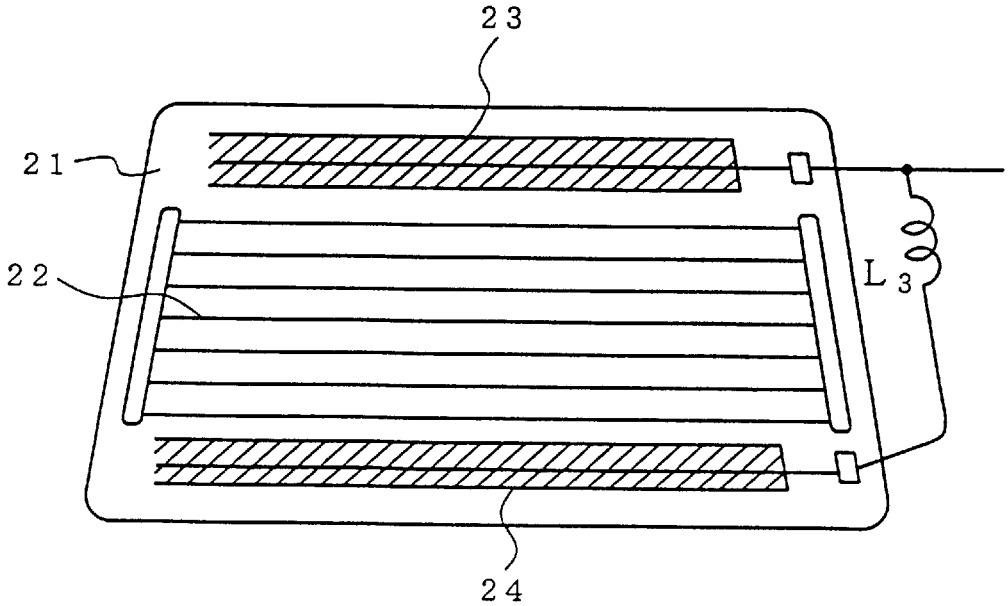
FIG. 4 shows occupied areas of the antenna patterns.

The total occupied area of these antenna patterns 23, 24 must be larger than 0.2 $m^2$. It should be noted that the word "occupied area" means area to be enveloped by the antenna pattern. In FIG. 4, there is shown each area occupied by the antenna patterns 23, 24 in a shaded manner by oblique lines, respectively.

While it is desirable for an AM receiving characteristic that the occupied area of antenna patterns is as large as possible, the occupied area is naturally limited because the antenna patterns are provided in a small space. If the occupied area has at least 0.2 $m^2$ as stated above, then a desired receiving characteristic may be obtained. It should be noted that the occupied area of antenna patterns can not exceed the area of the space other than the defogger on the rear window.

According to this embodiment, the occupied area of the AM/FM antenna pattern 23 is 0.13 $m^2$ and that of the AM antenna pattern 24 is 0.17 $m^2$, resulting in the total area of 0.30 $m^2$.

The received voltage in an AM band is obtained by synthesizing both voltages received by these antenna patterns, respectively. The synthesize is carried out by superimposing these received voltages. In this case, only the received voltage in AM band is derived from the AM antenna pattern 24 through a low-pass filter $L_3$ consisting of an inductor, and then is superimposed to the voltage received by the AM/FM antenna pattern 23. The low-pass filter $L_3$ causes the received voltage of AM antenna pattern 24 not to affect the high-frequency voltage of the AM/FM antenna pattern 23. The synthesized voltage is sent to a tuner through a coaxial feeder (not shown).

Figure 5:
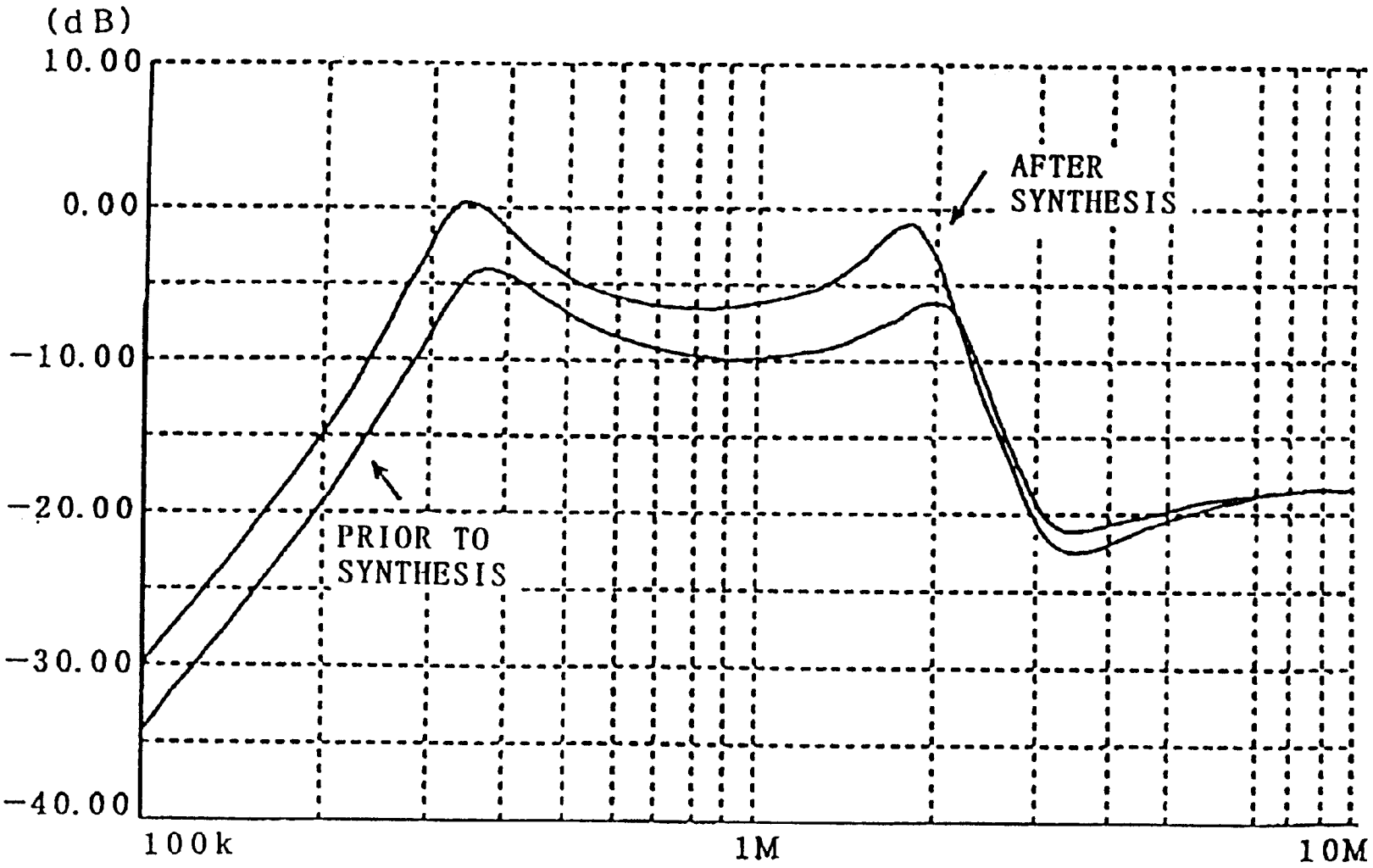
FIG. 5 shows a graph designating an enhancement of a sensitivity characteristic.

When the AM broadcast is received in the above-described glass window antenna system for motor vehicles, the AM received voltage from the AM/FM antenna pattern 23 and the AM received voltage from the AM antenna pattern 24 are synthesized. The synthesized voltage becomes larger than respective received voltages of the AM/FM antenna pattern 23 and the AM antenna pattern 24. The graph in FIG. 5 shows a sensitivity characteristic prior to and after the synthesis, in the FIG. the ordinate showing the received voltages in dB and the abscissa a frequency in Hz. It is understood that the receiving sensitivity after the synthesis has been increased by 5 dB in the AM band of 522–1629 kHz.

Where the total of occupied area of the AM/FM antenna pattern 23 and the AM antenna pattern 24 is varied, the difference between the resulting sensitivity and a target sensitivity is shown in Table 1. It is apparent from Table 1 that the total occupied area is required to be larger than 0.2 $m^2$.

TABLE 1

| Area occupied by antenna | Difference |
|---|---|
| 0.1 $m^2$ | −3 dB |
| 0.2 $m^2$ | 0 dB |
| 0.3 $m^2$ | 3 dB |
| 0.4 $m^2$ | 6 dB |

According to this embodiment, a desired AM receiving characteristic may be obtained by the synthesis of the AM received voltage of the AM/FM antenna pattern 23 and the AM received voltage of the AM antenna pattern 24.

Figure 6:
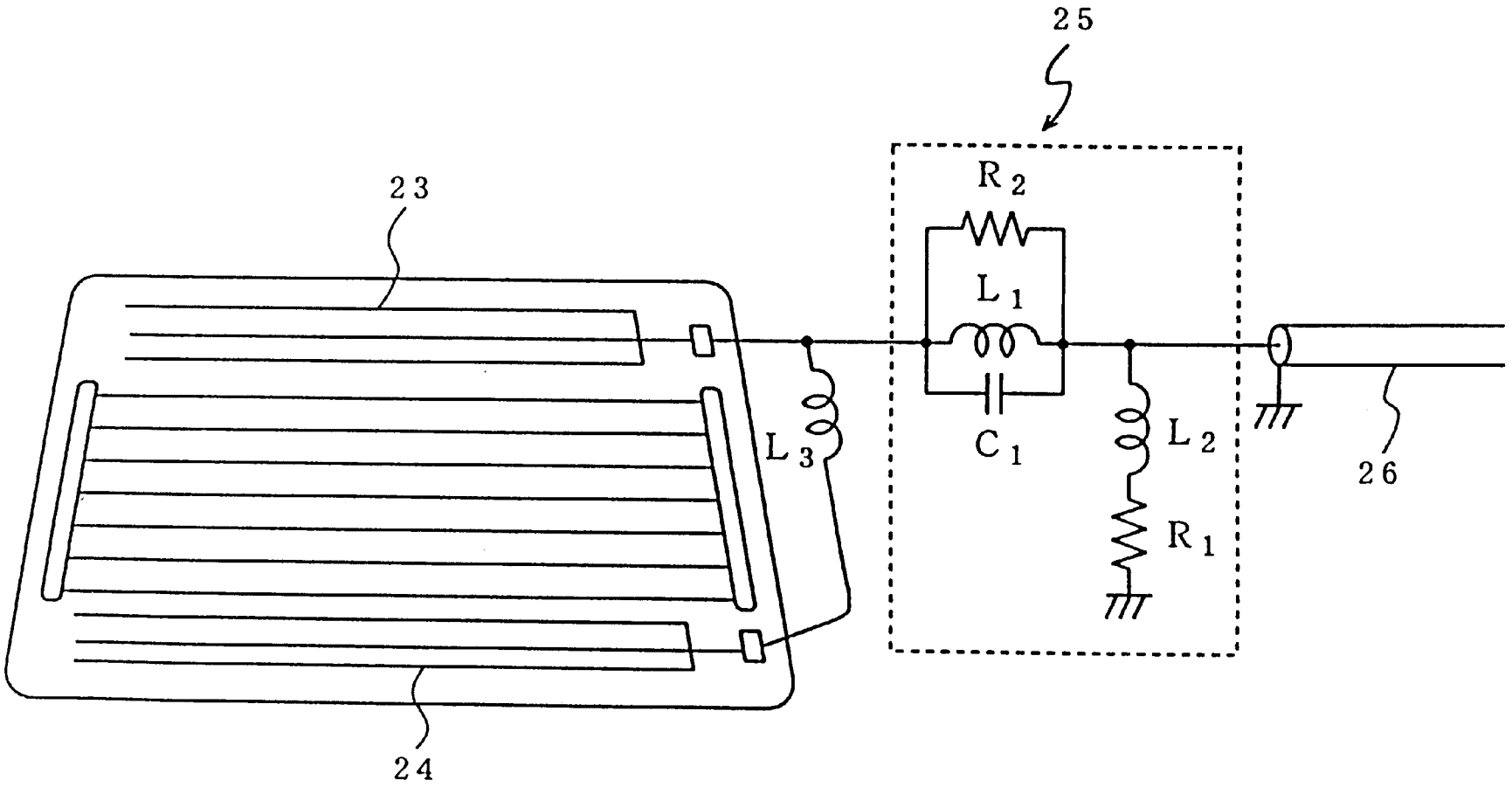
FIG. 6 shows a second embodiment of the present invention.

In order to increase the received voltage, a resonance circuit may by added. In FIG. 6, there is shown a second embodiment in which a resonance circuit 25 is added. The resonance circuit 25 in FIG. 6 comprises two resistors $R_1$, $R_2$, two inductors $L_1$, $L_2$ and one capacitor $C_1$. The resistors $R_1$, $R_2$ are damping resistors for decreasing the Q of resonance point. The capacitor $C_1$ is a high-pass filter for passing the FM voltage received by the AM/FM antenna pattern 23 to the tuner.

The values of these inductors, capacitor and resistors are, by way of example, $L_1$=68 $\mu$H, $L_2$=390 $\mu$H, $C_1$=56 pF, $R_1$=5.1 k$\Omega$, and $R_2$=5.1 k$\Omega$, respectively. The value of the inductor $L_3$ is 4 $\mu$H. The AM received voltage after synthesis is amplified by the resonance circuit 25 and sent to the coaxial feeder 26. Using such resonance circuit further increases the receiving sensitivity than that after synthesis shown in FIG. 5.

Figure 7:
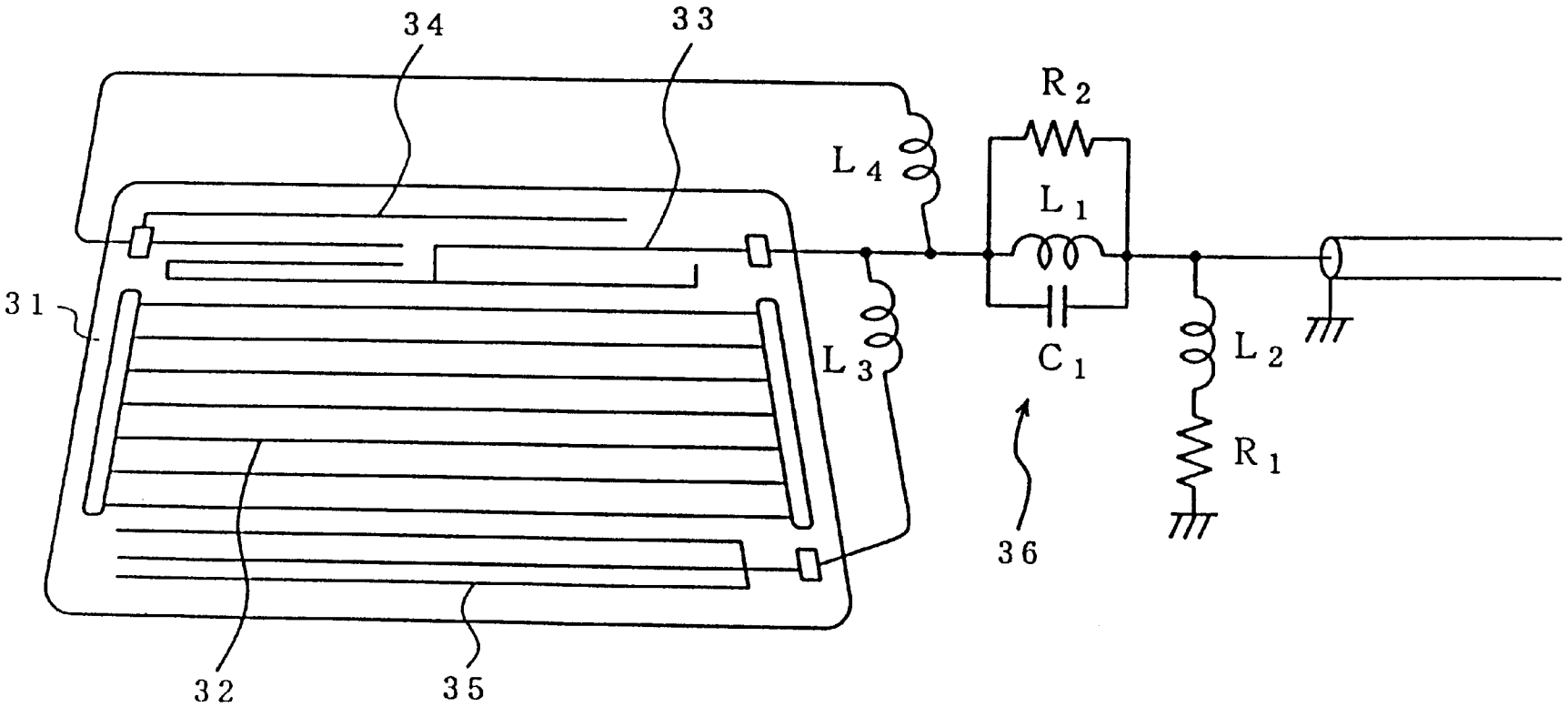
FIG. 7 shows a third embodiment of the present invention.

While the number of AM antenna patterns is one in the first and second embodiments, further AM antenna patterns may be added. FIG. 7 shows a third embodiment of the present invention, in which an AM/FM antenna pattern 33 and a first AM antenna pattern 34 are provided on an upper space to the heater wires 32 provided at the center area of the rear window glass plate 31, and a second AM antenna pattern 35 on a lower space to the heater wires 32. In this case, the AM/FM antenna pattern 33 has a substantially reversed T-shape, the first AM antenna pattern 34 has a fell down squared U-shape, and the second AM antenna pattern 35 has a fork-shape.

The AM voltage received by the first AM antenna pattern 34 and the AM voltage received by the second AM antenna pattern 35 are synthesized to the AM voltage received by the AM/FM antenna pattern 33. At this time, the AM received voltage of the first AM antenna pattern 34 passes through an inductor $L_4$ as a low-pass filter, and the AM received voltage of the second AM antenna pattern 35 passes through an inductor $L_3$ as a low-pass filter. According to this embodiment, a resonance circuit 36 is added so that the received voltage is further increased after synthesis. The structure of this resonance circuit 36 is the same as that of the resonance circuit 25 as shown in FIG. 6.

Figure 8:
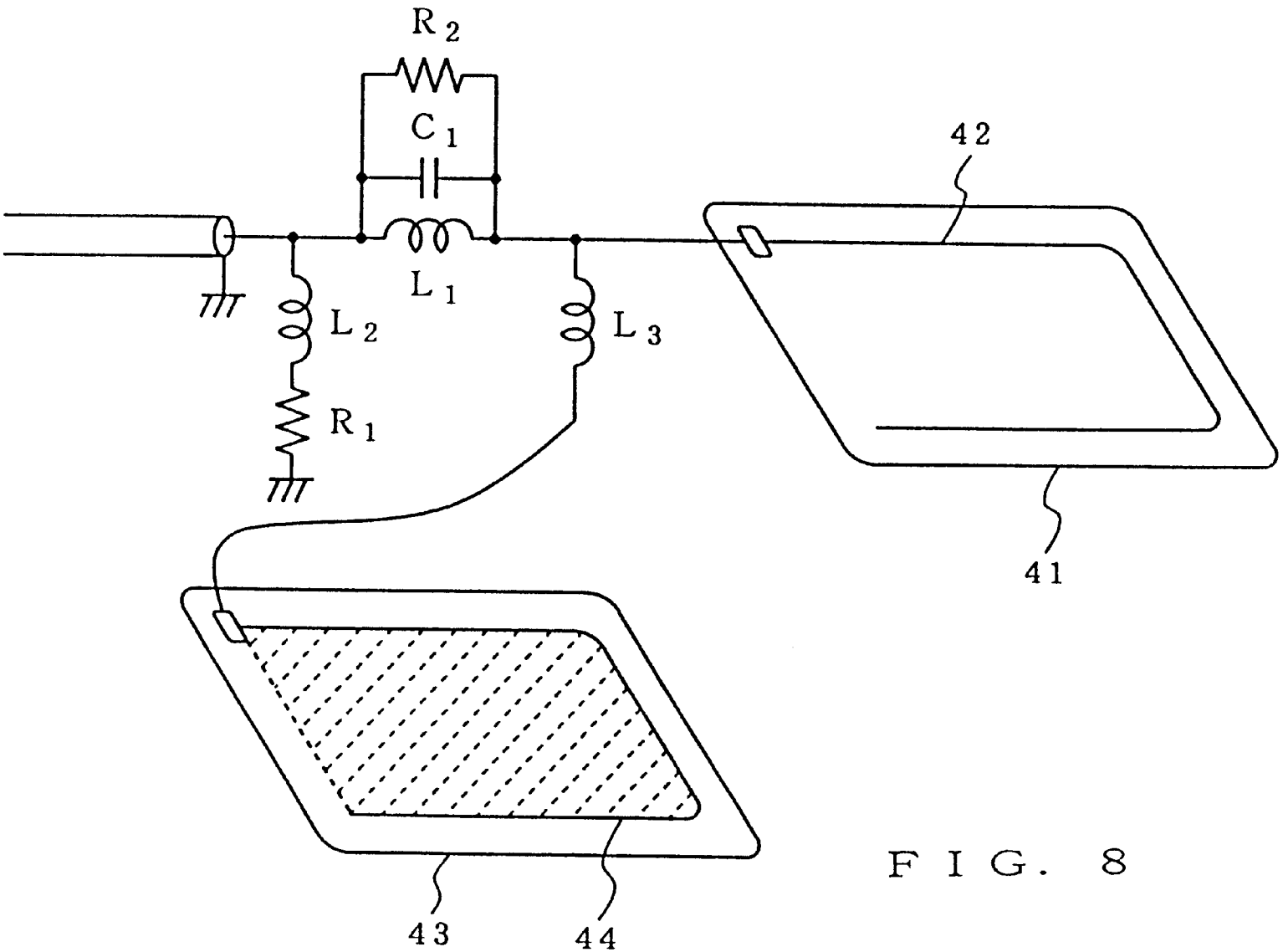
FIG. 8 shows a fourth embodiment of the present invention.

In each embodiment described above, the antenna patterns are provided on the rear window of motor vehicles, but the place where the antenna patterns are provided is not limited to the rear window. A fourth embodiment is shown in FIG. 8 where antenna patterns are provided on side windows.

An AM/FM antenna pattern 42 is provided on a first side window 41, and an AM antenna pattern 44 is provided on a second side window 43. Each of these antenna patterns 42, 44 has a U-shape extended around the peripheral of each of the windows. The structure of the synthesis circuit and resonance circuit is the same as that in the second embodiment. The occupied area of the antenna pattern 44 is denoted by dotted oblique lines in the figure. It is noted that each area occupied by the AM/FM antenna pattern 42 or the AM antenna pattern 44 is limited within the area of respective side window 41 or 43.

It is also possible to provide the antenna patterns on both a rear window and a side window. In this case, an AM/FM antenna pattern is provided on a rear window, while an AM antenna pattern is provided on a side window. Alternatively, it is possible to provide an AM/FM antenna pattern on a rear window, a first AM antenna pattern on a first side window, and a second AM antenna pattern on a second side window.

Each shape of the AM/FM antenna pattern and the AM antenna pattern in the embodiments described above is shown by way of example, so that the shape of an antenna pattern is not intended to restrict to that of these antenna patterns. As described hereinbefore, any shape of AM/FM antenna pattern is allowed in which AM sensitivity characteristic is ensured without degrading FM sensitivity characteristic significantly.

While the invention has been described in terms of preferred embodiments, those skilled in the art will recognize that the invention can be practiced with modification within the spirit and scope of the appended claims.

What is claimed is:

1. A glass window antenna system for motor vehicles comprising:

a plurality of defogging heater wires provided at a center area of a rear window, one AM/FM antenna pattern provided on the rear window for mainly receiving an FM band while maintaining an AM receiving characteristic, one or more AM antenna patterns provided on the rear window for receiving an AM band, and one or more low-pass filters through which a first AM voltage received by the AM antenna patterns is superimposed on a second AM voltage received by the AM/FM antenna pattern to synthesize the first and second received AM voltages, wherein the total occupied area of the AM/FM antenna pattern and the AM antenna patterns is at least 0.2 $m^2$, and wherein one antenna element of the AM/FM antenna pattern and one wire element of the defogging heater wires are opposed to each other and separated by a distance of between 10–30 mm, and one antenna element of the AM antenna patterns and an other wire element of the defogging heater wires are opposed to each other and separated by a distance of between 10–30 mm.

2. A glass window antenna system for motor vehicles according to claim 1 further comprising a resonance circuit for increasing the synthesized AM received voltage.

3. A glass window antenna system for motor vehicles according to claim 1 or 2 wherein each of the low pass filters consists of an inductor.

4. A glass window antenna system for motor vehicles comprising:

a plurality of defogging heater wires provided at a center area of a rear window, one AM/FM antenna pattern provided on the rear window for mainly receiving an FM band while maintaining an AM receiving characteristic, one or more AM antenna patterns provided on at least one side window for receiving an AM band, and one or more low-pass filters through which a first AM voltage received by the AM antenna patterns is superimposed on a second AM voltage received by the AM/FM antenna pattern to synthesize the first and second received AM voltages, wherein the total occupied area of the AM/FM antenna pattern and the AM antenna patterns is at least 0.2 $m^2$, and wherein one antenna element of the AM/FM antenna pattern and one wire element of the defogging heater wires are opposed to each other and separated by a distance of between 10–30 mm.

5. A glass window antenna system for motor vehicles according to claim 4 further comprising a resonance circuit for increasing the synthesized AM received voltage.

6. A glass window antenna system for motor vehicles according to claim 4 or 5, wherein each of the one or more low-pass filters consists of an inductor.

* * * * *